US007077537B2

(12) United States Patent
Hui

(10) Patent No.: US 7,077,537 B2
(45) Date of Patent: Jul. 18, 2006

(54) UNDERWATER LIGHT FOR SOFT-SIDED ABOVEGROUND POOLS

(75) Inventor: Joseph Wing-Tak Hui, Cupertino, CA (US)

(73) Assignee: Smartpool, Inc., Lakewood, NJ (US)

( * ) Notice: Subject to any disclaimer, the term of this patent is extended or adjusted under 35 U.S.C. 154(b) by 0 days.

(21) Appl. No.: 10/960,068

(22) Filed: Oct. 8, 2004

(65) Prior Publication Data

US 2005/0128731 A1 Jun. 16, 2005

Related U.S. Application Data

(60) Provisional application No. 60/509,537, filed on Oct. 9, 2003.

(51) Int. Cl.
*F21V 33/00* (2006.01)

(52) U.S. Cl. ..... 362/101; 362/370; 4/496

(58) Field of Classification Search ..... 362/101, 362/96, 396, 368, 370, 318, 145; 4/488, 4/496–505

See application file for complete search history.

(56) References Cited

U.S. PATENT DOCUMENTS

| | | | | | |
|---|---|---|---|---|---|
| 2,968,208 | A | * | 1/1961 | Shaw | 359/406 |
| 3,456,103 | A | * | 7/1969 | Bond | 362/267 |
| 3,793,516 | A | * | 2/1974 | Cassey | 362/257 |
| 3,801,022 | A | * | 4/1974 | Cassey | 362/257 |
| 3,816,740 | A | | 6/1974 | Rambusch et al. | |
| 3,955,076 | A | * | 5/1976 | Shaw | 362/183 |
| 4,053,758 | A | * | 10/1977 | Shaw | 362/158 |
| 4,216,411 | A | | 8/1980 | Ehret et al. | |
| 4,394,716 | A | | 7/1983 | Campagna et al. | |
| 4,503,489 | A | | 3/1985 | Duerr et al. | |
| 4,574,337 | A | | 3/1986 | Poppenheimer | |
| 4,779,174 | A | | 10/1988 | Staten et al. | |
| 4,947,304 | A | | 8/1990 | Payne et al. | |
| 4,999,758 | A | * | 3/1991 | Wimberly | 362/373 |
| 5,016,151 | A | | 5/1991 | Mula | |
| 5,045,978 | A | | 9/1991 | Gargle | |
| 5,051,875 | A | | 9/1991 | Johnson | |
| 5,089,945 | A | | 2/1992 | Mula | |
| 5,144,545 | A | * | 9/1992 | Klitzing | 362/101 |
| 5,144,546 | A | * | 9/1992 | Burdi | 362/191 |
| 5,299,103 | A | | 3/1994 | Kielland | |
| 5,607,224 | A | | 3/1997 | Tobias et al. | |
| 5,622,422 | A | | 4/1997 | Rodgers | |
| 5,702,082 | A | * | 12/1997 | Evans et al. | 248/230.1 |
| 5,800,041 | A | | 9/1998 | Poggi | |
| 5,842,771 | A | | 12/1998 | Thrasher et al. | |
| 5,921,669 | A | * | 7/1999 | Taylor et al. | 362/476 |
| 6,021,033 | A | | 2/2000 | Benham et al. | |
| 6,315,424 | B1 | | 11/2001 | Hui | |

* cited by examiner

*Primary Examiner*—Sandra O'Shea
*Assistant Examiner*—Jacob Y. Choi
(74) *Attorney, Agent, or Firm*—Birch, Stewart, Kolasch & Birch, LLP

(57) ABSTRACT

An underwater light for use with soft-sided aboveground pools includes a watertight light fixture utilizing a low voltage (12V) current for use in underwater illumination of a swimming pool. A mounting assembly is provided that is attached to the light fixture for allowing attachment of the assembly to a support frame of a soft-sided aboveground pool. A transformer is provided for containing controls for an automatic timer and for providing variable intensity lighting to the system.

1 Claim, 3 Drawing Sheets

UNDERWATER LIGHT FOR SOFT-SIDED ABOVEGROUND POOLS

This Nonprovisional application claims priority under 35 U.S.C. § 119(e) on U.S. Provisional Application No(s). 60/509,537 filed on Oct. 9, 2003, the entire contents of which are hereby incorporated by reference.

FIELD OF THE INVENTION

The present invention relates to an underwater light combined with an integral mounting structure for attachment to the support frame of a soft-sided aboveground pool.

DESCRIPTION OF BACKGROUND ART

With the introduction of a "soft-sided" aboveground pool, the ability of the pool owner to add an underwater light has been reduced to only one type: an integral light structure which fits into the return water fitting of the pool wall. This type of light was originally designed for hard-sided aboveground pools with flat vertical sides.

Due to the curved profile of the soft-sided pool, most wall fittings have a tendency to leak, especially when the bulk of a light fitting is added to the return water fitting. In addition, the location of the return fitting may not provide the optimum location for lighting the pool.

Another common difficulty of any existing lights for soft-sided pools is the difficulty of installing the light on an existing pool. Draining the pool is required to insert the light fitting through the wall.

SUMMARY OF THE INVENTION

There is a need for a specially mounted, easily installed underwater light for use on soft-sided pools that eliminates the possibility of creating a leak in the wall fitting; is easily installed without draining of the pool; and allows for installation anywhere on the pool for optimum lighting of the water.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
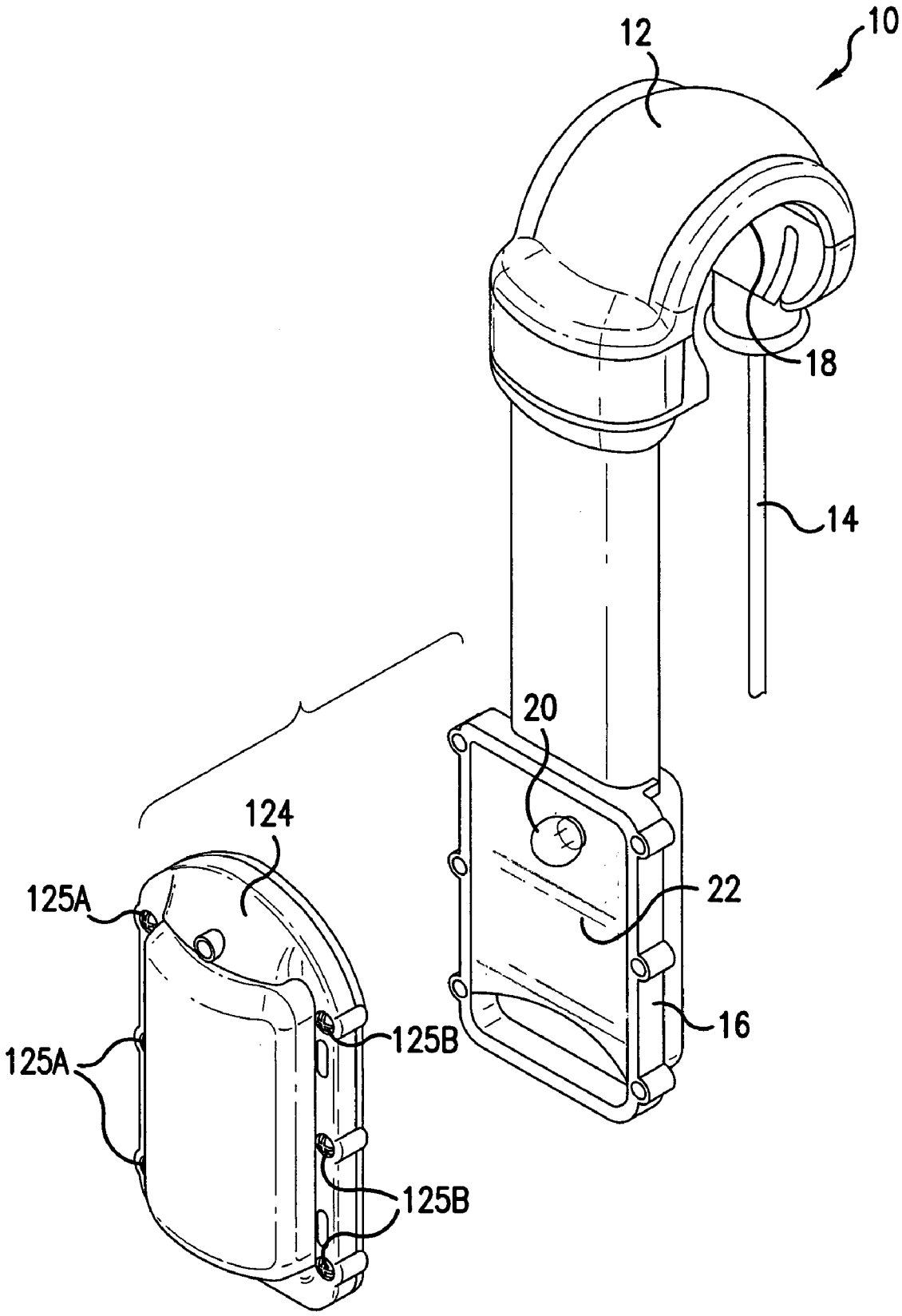
FIG. 1 is a perspective view illustrating an underwater light for a soft sided pool according to the present invention.

As illustrated in FIG. 1, in the preferred embodiment, the light fixture 10 is combined with an integral mounting structure 12 that encases the wiring 14 from the lightbox 16 over the pool wall to the outside of the pool. The integral mounting structure 12 may include a protective pad 18 that may be constructed of a rubber padding for protecting the pool frame 40 and liner from abrasion. An adjustment mechanism 24 allows the device 10 to be secured properly to various diameters of pipe frames commonly used in this type of pool.

As illustrated in FIG. 1, the cover 124 of the lightbox 16 is removed to permit a bulb 20 and a special concave reflective backing 22 to be seen. The mounting structure 12 contains the wiring 14 therein and is connected to a transformer (not illustrated) in compliance with UL 676 standards governing electrical devices on storable pools, which include an automatic timer that switches off the light after three hours and internal electronics which allow the user to choose a lower (20 watt) or higher (50 watt) light intensity. The cover 124 may be secured to the lightbox 16 by means of screws 125A and 125B to permit the cover 124 to be mounted on the lightbox 16 in a water tight arrangement.

Figure 2:
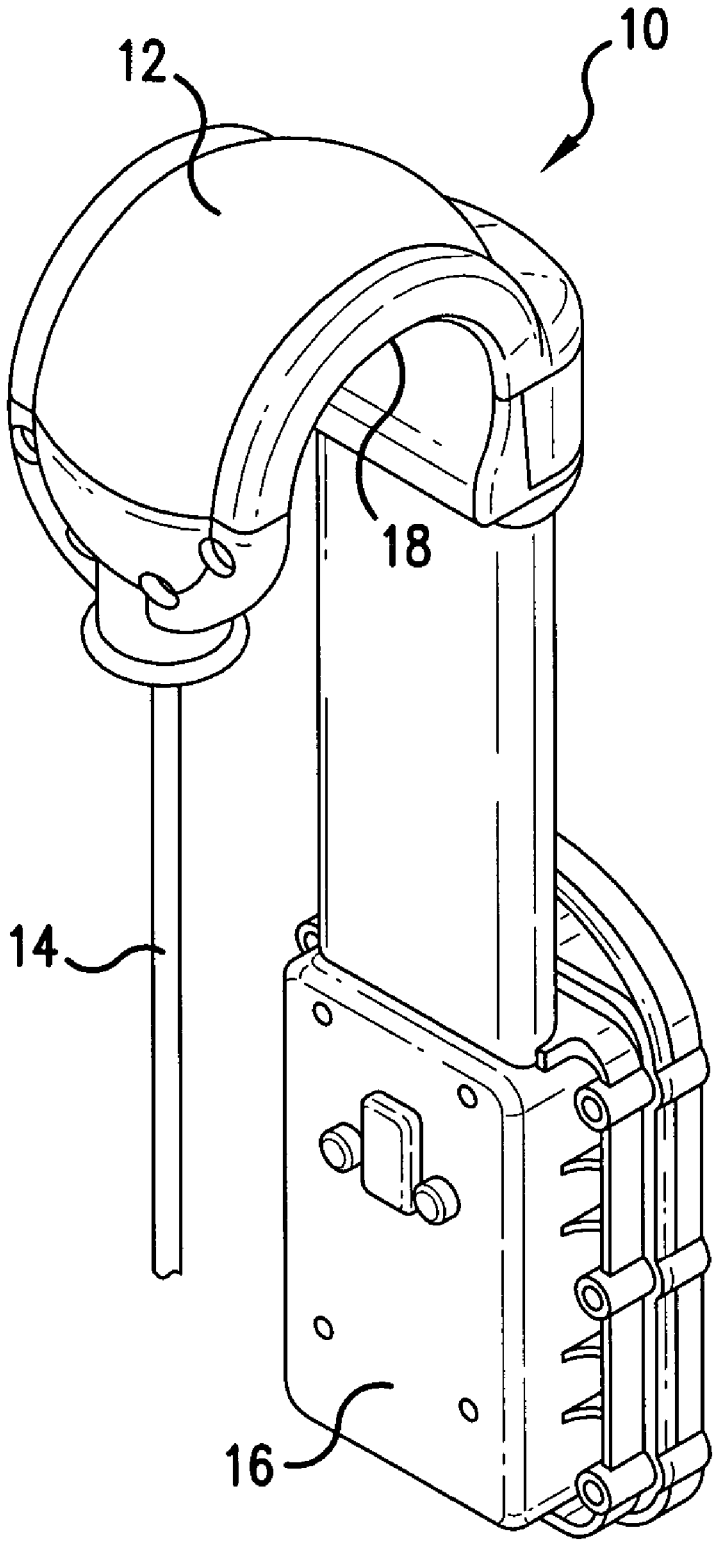
FIG. 2 is a rear perspective view illustrating the underwater light for a soft sided pool according to the present invention.

FIG. 2 is a rear perspective view illustrating the underwater light for a soft sided pool according to the present invention wherein the light fixture 10 includes the integral mounting structure 12 that encases the wiring 14 from the lightbox 16 over the pool wall to the outside of the pool and that protects the pool frame 40 and liner from abrasion by using the protective pad 18 as part of the mounting assembly. The protective pad 18 together with the adjustment mechanism 24 allows the device 10 to be secured properly to various diameters of pipe frames commonly used in this type of pool.

Figure 3:
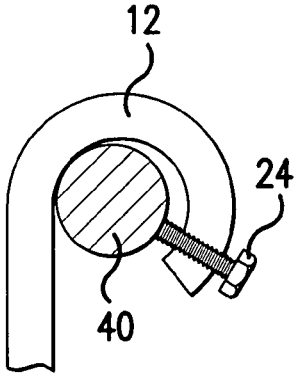
FIG. 3 is a schematic view illustrating an attachment for the underwater light for a soft sided pool according to the present invention.
Figure 4:
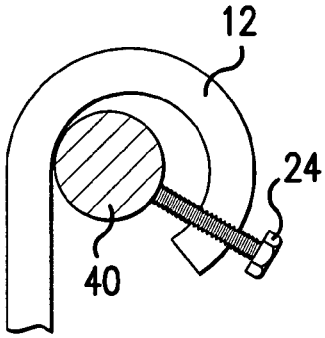
FIG. 4 is a schematic view similar to FIG. 3 illustrating the range of adjustment for the attachment for the underwater light for a soft sided pool according to the present invention.

FIGS. 3 and 4 are schematic views illustrating an attachment for the underwater light for a soft sided pool according to the present invention. In a preferred embodiment, the integral mounting structure 12 is formed to include a section that is greater than 180° in diameter. In this way, the integral mounting structure 12 may be positioned over the pipe frame 40 of the pool with the adjustment mechanism 24 being disposed adjacent to a lower surface of the pipe frame 40. The adjustment mechanism 24 may be a screw that is tightened to secure the mounting structure 12 to the pipe frame 40. As illustrated in FIG. 4, a range of adjustment is available with the adjustment mechanism 24.

Figure 5:
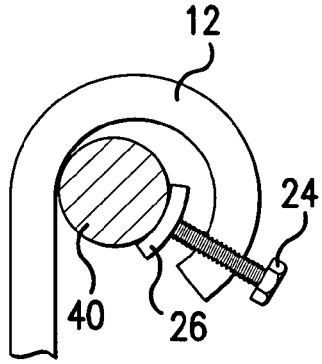
FIG. 5 is a schematic view of another embodiment of the attachment for the underwater light.

FIG. 5 is a schematic view of another embodiment of the attachment for the underwater light. Again, the integral mounting structure 12 is formed to include a section that is greater than 180° in diameter. In this way, the integral mounting structure 12 may be positioned over the pipe frame 40 of the pool with the adjustment mechanism 24 being disposed adjacent to a lower surface of the pipe frame 40. A protective pad 26 may be positioned between the adjustment mechanism 24 and the pipe frame 40 for ensuring a proper attachment of the mounting structure 12 to the pipe frame 40.

Figure 6:
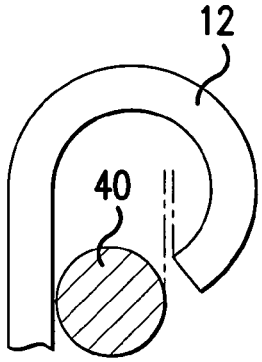
FIG. 6 is a schematic view of another embodiment of the attachment for the underwater light.

FIG. 6 is a schematic view of mounting structure 12 that is formed to include a section that is greater than 180° in diameter. The opening that is provided in the lower section of the mounting structure 12 must be larger that the diameter of the pipe frame 40 to permit the mounting structure 12 to be positioned over the pipe frame 40 of the pool.

Figure 7:
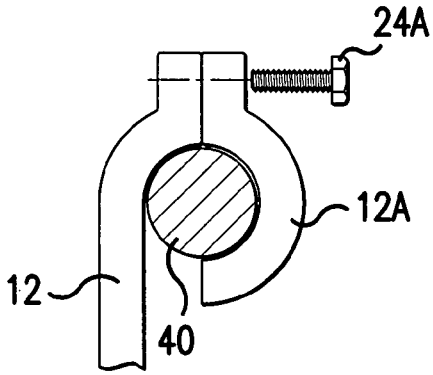
FIG. 7 is a schematic view of another embodiment of the attachment for the underwater light.

FIG. 7 is a schematic view of another embodiment of the attachment for the underwater light wherein the mounting structure 12 includes a member 12A that is secured to the mounting structure 12 by means of an securing mechanism 24A. The securing mechanism 24A may be a screw for securing the mounting structure 12 to the pipe frame 40 of the pool.

Figure 8:
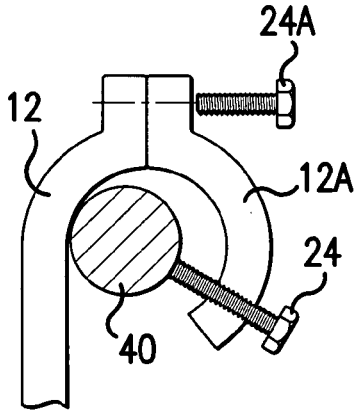
FIG. 8 is a schematic view of another embodiment of the attachment for the underwater light.

FIG. 8 is a schematic view of another embodiment of the attachment for the underwater light wherein the mounting structure 12 includes a member 12A that is secured to the mounting structure 12 by means of an securing mechanism 24A. The securing mechanism 24A may be a screw for securing the mounting structure 12 to the pipe frame 40 of the pool. In addition, the adjustment mechanism 24 may be provided to ensuring the mounting of the mounting structure 12 to the pipe frame 40 of the pool.

Figure 9:
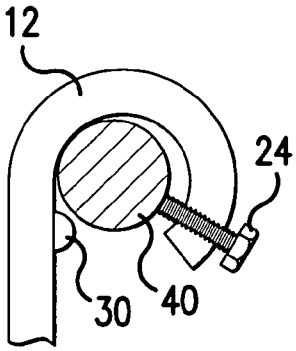
FIG. 9 is a schematic view of another embodiment of the attachment for the underwater light.

FIG. 9 is a schematic view of another embodiment of the attachment for the underwater light wherein the mounting structure 12 includes a projection 30 extending inwardly therefrom for accurately positioning the mounting structure 12 relative to the pipe frame 40 of the pool. The projection 30 provides a larger contact area for the clamping angle of the mounting structure 12 and permits an easier use of the adjustment mechanism 24 that is provided for ensuring that the mounting structure 12 is affixed to the pipe frame 40 of the pool.

The present invention is also directed to a method for installing the mounting structure 12 onto a vessel of water such as a soft side pool by using a single mounting point. It is preferable to make the single mounting point to be positioned at the top rail or the frame of the vessel structure. The frame of the vessel could be made of the pipe frame 40. The most commonly used pipe frame 40 is generally of a round shape. In order to secure the mounting structure 12 to clamp the pipe frame 40 the mounting structure 12 should be over 180° in cross-section. In this way, the mounting structure 12 will fit over the pipe frame 40 to permit the mounting structure 12 to be able to be positioned over a variety of diameters of the pipes used to construct the pipe frame 40. In the drawings the mounting structure 12 is illustrated as being used together with a lightbox 16. However, the mounting structure 12 may be used together with a variety of apparatus that are desired to be mounted relative to a vessel.

In the embodiments illustrated in FIGS. 3–9, the adjustment mechanism 24 may be covered with a decorative cover to cover the clamping mechanism for holding the mounting structure 12 relative to the pipe frame 40 of the soft-sided above ground pool. A threaded connection may be provided for attaching the decorative cover to the mounting structure 12 for hiding the attachment mechanism 24. A conduit may be provided within the mounting structure 12 for providing a channel for permitting the passage of the electrical cable 14 to pass outside the soft-sided above ground pool.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. An underwater light for use with soft-sided above ground pools comprising;

a housing;

a mounting assembly secured to an upper end of the housing, the mounting assembly being adapted for attachment of the mounting assembly to a support frame of a soft-sided above ground pool, the mounting assembly including:

a first portion secured to the housing; and an upper portion projecting from the housing and being curved to extend upwardly and outwardly for accommodating a support frame of a soft-sided above ground pool, the upper portion includes a substantially semi-circular open portion for forming an open space for positioning directly on the support frame of a soft-sided above ground pool for mounting the underwater light directly relative there to permit direct mounting and removal of the mounting assembly on the support frame without removing an attachment member; and a light fixture mounted within the housing for providing illumination of the pool.

* * * * *